US007793729B2

(12) United States Patent
Nikiforuk

(10) Patent No.: US 7,793,729 B2
(45) Date of Patent: Sep. 14, 2010

(54) GATE VALVE AND METHOD OF CONTROLLING PRESSURE DURING CASING-WHILE-DRILLING OPERATIONS

(75) Inventor: Kevin J. Nikiforuk, Houston, TX (US)

(73) Assignee: Tesco Corporation, Houston, TX (US)

( * ) Notice: Subject to any disclaimer, the term of this patent is extended or adjusted under 35 U.S.C. 154(b) by 0 days.

(21) Appl. No.: 12/176,763

(22) Filed: Jul. 21, 2008

(65) Prior Publication Data

US 2010/0012328 A1 Jan. 21, 2010

(51) Int. Cl.
*E21B 34/16* (2006.01)

(52) U.S. Cl. ..... 166/374; 166/98

(58) Field of Classification Search ..... 166/86.3, 166/97.1, 95.1; 251/1.3, 31, 62, 326, 193
See application file for complete search history.

(56) References Cited

U.S. PATENT DOCUMENTS 4,222,406 A * 9/1980 Schaefer ..... 137/246.22
4,428,421 A 1/1984 Rankin
4,572,298 A * 2/1986 Weston ..... 166/379
4,612,983 A * 9/1986 Karr, Jr. ..... 166/55
4,938,290 A * 7/1990 Leggett et al. ..... 166/387
5,884,899 A * 3/1999 Brenes ..... 251/335.3
2001/0042848 A1 * 11/2001 Bartlett ..... 251/62
2006/0032638 A1 2/2006 Giroux et al.

OTHER PUBLICATIONS

U.S. Appl. No. 11/458,294, filed Jul. 18, 2006, Angman et al.

* cited by examiner

*Primary Examiner*—David J Bagnell
*Assistant Examiner*—James G Sayre
(74) *Attorney, Agent, or Firm*—Bracewell & Giuliani LLP

(57) ABSTRACT

A safety valve has a body with a passage extending through it that intersected by a chamber and inclined guide surfaces located in the chamber. A single slab gate with an aperture has ramp surfaces on one side. When moving from the open position to the closed position, the ramp surfaces slide onto the guide surfaces and push the gate into sealing engagement with a side of the chamber to block the passage. The safety valve is particularly useful during a casing-while-drilling operation wherein it is mounted to the upper end of the casing when the casing gripper and top drive are disconnected from the casing string.

16 Claims, 5 Drawing Sheets

GATE VALVE AND METHOD OF CONTROLLING PRESSURE DURING CASING-WHILE-DRILLING OPERATIONS

BACKGROUND OF THE INVENTION

Most oil and gas wells are drilled by using drill pipe to form the borehole. When a desired depth is reach, the operator connects together a string of casing, lowers it into the well, and cements it into the well. The operator may then drill deeper and run additional strings of casing.

In another technique, known as casing-while-drilling, the casing serves as the drill string, thus is located in the borehole while the well is being drilled. A bottom hole assembly at the lower end of casing includes a drill bit and an under reamer. The upper end of the casing is connected to a casing gripper, which in turn is connected to a top drive of a drilling rig. The casing gripper provides a seal for drilling fluid pumped down from the top drive into the interior of the casing. The casing gripper also supports the weight of the casing and transmits from the top drive torque to rotate the casing and the drill bit at the lower end of the casing. In some cases, the bottom hole assembly includes a mud motor that rotates the drill bit relative to the casing, the mud motor being driven by drilling mud pumped downwardly through it.

Since the string of casing extends upward through the conventional rig annular blowout preventer, closing the blowout preventer will only close the annulus surrounding the casing; it will not close the bore of the casing. On occasion, unexpected high pressure can be encountered, referred to as a "kick", which would tend to push the drilling fluid up out of the casing. If the casing gripper and top drive are connected to the casing, the operator can control the kick by pumping fluid downward through the top drive and into the bore of the casing.

There are times, however, when the casing gripper and top drive will be detached from the casing. Of course, this occurs as each new joint of casing is picked up and secured to the upper end of the string of casing during the drilling operations. That interval is fairly short. More lengthy intervals occur, such as when rigging up to retrieve and/or rerun the bottom hole assembly. These operations are required if the pilot bit is worn and needs to be replaced prior to reaching total depth. Also, unless the bottom hole assembly is to be cemented in the well, it must be retrieved when the casing is at total depth and before cementing. Retrieval and re-running can be done a number of ways: with wireline; pumping the bottom assembly in and/or out; and tripping drill pipe into and out of the string of casing.

During the rig up and rig down time for retrieving a bottom hole assembly, it would be desirable to have an ability to control any unexpected pressure kick that might occur. Also, having a system of pressure control during the retrieval or rerun operation is important.

SUMMARY OF THE INVENTION

In this invention, a safety valve is provided with upper and lower passage portions intersected by a horizontally extending chamber. The safety valve has a gate with an aperture therethrough and a circulation port leading to the lower passage portion. During certain casing-while-drilling operations, the operator removes the casing gripper from the string of casing and secures the safety valve to the string of casing with the upper and lower passages aligned with the bore of the string of casing. The operator may then convey a downhole tool through the safety valve while the gate is in the open position. In the event of an increase in pressure occurring in the string of casing while the top drive and the casing gripper are detached from the string of casing, the operator can close the gate and pump a fluid through the circulation port into the string of casing. The safety valve has the ability to support the weight of the string of casing and can be placed on top of the rotary table.

In addition, the operator can secure a conduit to the upper end of the safety valve. If the conduit above the safety valve is long enough, the bottom hole assembly when being retrieved can pass upward through the safety valve into the conduit. The operator can then close the safety valve and remove the bottom hole assembly from the conduit. This method can be used both for a pump in and pump out trip for the bottom hole assembly as well as one using wireline.

Preferably, the safety valve has inclined guide surfaces on the lower side of the chamber and ramp surfaces on the lower side of the gate. When the gate is being closed, the ramp surfaces engage the guide surfaces, pushing the gate upwardly into sealing contact with an upper side of the chamber.

In one embodiment, the gate has rollers or other friction-reducing elements on the lower side for moving along the lower side of the chamber until reaching the inclined guide surfaces. During the stroking movement before reaching the inclined guide surfaces, a clearance exists between the upper side of the gate and the lower side of the chamber to preserve the seal.

In one embodiment, the circulation port extends through the body of the safety valve and registers with a circulation port formed in a lower side of the gate. The circulation port in the gate may be an open channel that faces downwardly and is located on the lower side of the gate.

DETAILED DESCRIPTION OF THE INVENTION

Figure 1:
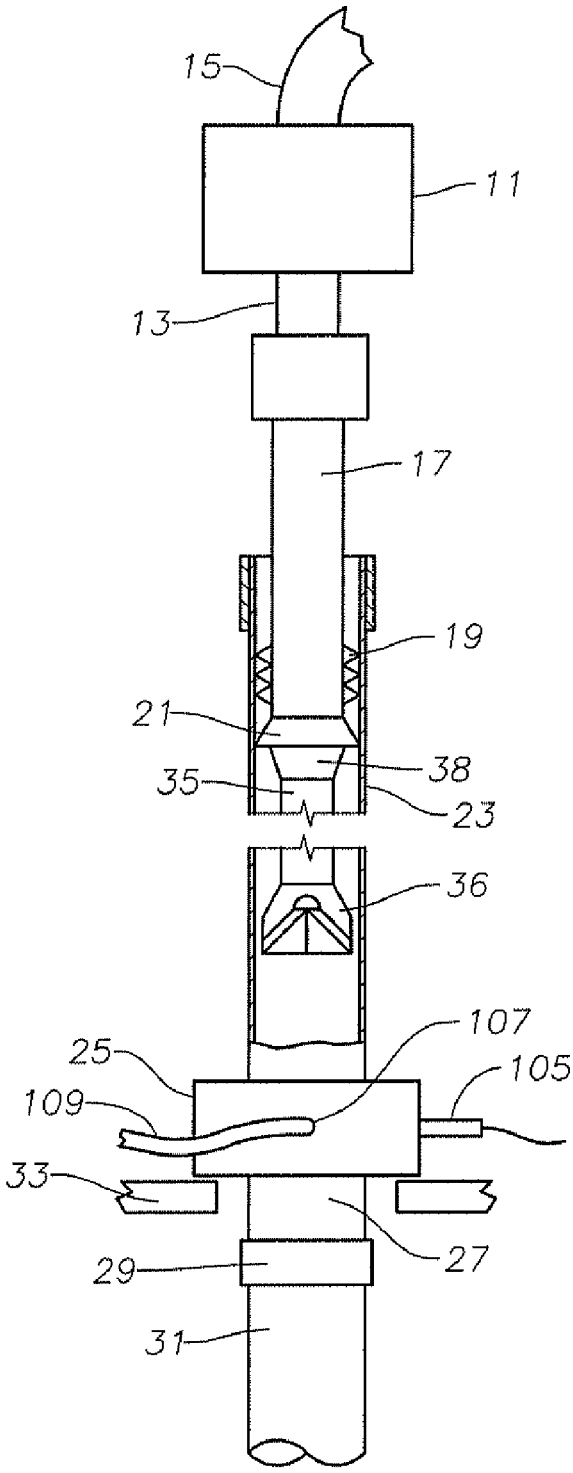
FIG. 1 is a schematic view illustrating a bottom hole assembly pump-in or pump-out procedure, and employing a safety valve in accordance with this invention.

Referring to FIG. 1, the drilling rig has a top drive 11 with a rotatable stem or quill 13. Top drive 11 is capable of moving upward and downward in the derrick as well as rotating quill 13. A drilling fluid hose 15 extends to top drive 11 for pumping drilling fluid through quill 13. A casing gripper 17 is illustrated as being connected to quill 13. Casing gripper 17 has slips 19 and a seal 21 that seals the interior of a conduit 23. In this example, slips 19 are schematically shown as being inserted into conduit 23. Slips 19 are actuated by an actuator portion of casing gripper 17, which moves them to a gripping position engaging the interior of conduit 23. Alternately, slips 19 could be configured to slide over and grip the exterior of conduit 23. When engaged, slips 19 will support the weight of conduit 23 as well as transmit rotation to conduit 23.

In the example of FIG. 1, a safety valve 25 is secured to the lower end of conduit 23. An adapter 27 is secured to a lower end of safety valve 25 and is shown coupled to a casing collar 29 of a string of casing 31 extending into the well. The term "casing" is used broadly to include other tubulars that may be cemented in a well, such as liners. Preferably, adapter 27 is of a type that uses a rotating nut that enables the connection to collar 29 to be made without having to rotate safety valve 25. Safety valve 25 is shown being supported on a rotary table 33 of the drilling rig.

The operation occurring in FIG. 1 illustrates one use of safety valve 25, which is during a pump in or pump out trip of a bottom hole assembly 35. Bottom hole assembly 35 typically includes a drill bit 36 forming its lower end, as well as a reamer (not shown) and optionally other equipment such as logging instruments and a mud motor. During a pump in procedure, drilling fluid is pumped from mud hose 15 through top drive 11 into contact with seals (not shown) on bottom hole assembly 35, causing it to move downward to the lower end of casing 31. During pump out, a reverse circulation is created, resulting in the drilling mud in the annulus surrounding casing 31 flowing down the annulus and up the open lower end of casing 31. The upward flowing drilling fluid pushes bottom hole assembly 35 upward through safety valve 25 and into conduit 23. The drilling fluid above bottom hole assembly 35 being displaced by the upward movement would flow in reverse up through top drive 11 and out hose 15.

Preferably conduit 23 has a length greater than the bottom hole assembly 35 so that drill bit 36 is located within conduit 23 when bottom hole assembly 35 is at its uppermost position. A tool catcher 38 may be attached to the nose portion of casing gripper 17; tool catcher 38 will latch to and support the weight of bottom hole assembly 35. The upper end of bottom hole assembly 35 latches to tool catcher 38 when bottom hole assembly 35 reaches the uppermost position. Tool catcher 38 optionally could also support bottom hole assembly 35 in conduit 23 before it is launched into casing 31.

When drill bit 36 is located in conduit 23 above safety valve 25, safety valve 25 may be closed. This allows the operator to disengage casing gripper slips 19 and lift bottom hole assembly 35 from conduit 23 with top drive 11 and casing gripper 17 while safety valve 25 maintains pressure control of casing 31. Closing safety valve 25 also allows bottom hole assembly 35 to be lifted by top drive 11 and casing gripper 17 and inserted into conduit 23 for re-running while pressure control is maintained.

While safety valve 25 is supported on rotary table 33 as shown in FIG. 1, the weight of casing 31 is transferred through safety valve 25 to rotary table 33. If desired, while connected to top drive 11 via conduit 23 and casing gripper 17, the operator can lift and lower safety valve 25 and casing 31 with top drive 11. That might occur if the operator wishes to reciprocate casing 31 up and down to avoid sticking while bottom hole assembly 35 is being pumped in or out.

Figure 2:
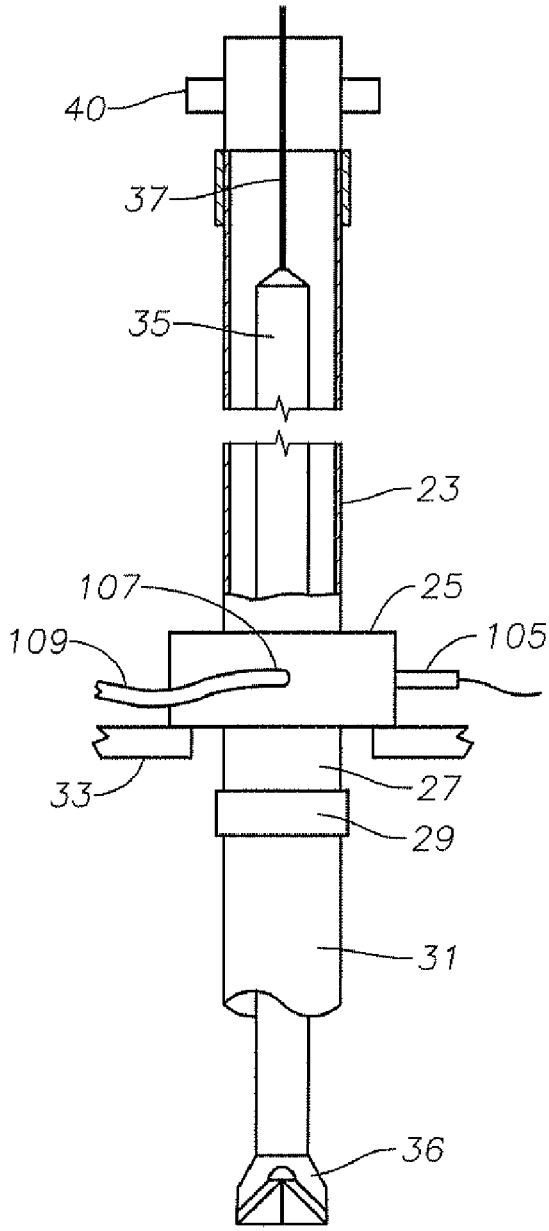
FIG. 2 is a schematic view of illustrating the bottom hole assembly being lowered or retrieved on a wireline through the safety valve of FIG. 1.

Referring to FIG. 2, in this casing-while-drilling operation, casing gripper 17 and top drive 11 (FIG. 1) are disconnected from conduit 23. Bottom hole assembly 35 is shown being lowered or retrieved on a wireline 37 through conduit 23 and safety valve 25. Preferably a wireline blowout preventer 40 is mounted to the upper end of conduit 23 for sealing around wireline 37 in the event of a pressure kick. Wireline blowout preventer 40 may also employ a packoff that allows the wireline 37 to be run in or out while conduit 23 and casing 31 are under internal fluid pressure. Wireline blowout preventer 40 may be mounted to a wireline entry sub that supports a sheave for the wireline 37.

As in FIG. 1, conduit 23 is preferably longer than the length of bottom hole assembly 35. Safety valve 25 can thus be closed to maintain well control while drill bit 36 is within conduit 23. The wireline retrieval assembly can be rigged up and rigged down while safety valve 25 is closed. Also, by providing wireline shearing capability in safety valve 25, in the event of emergency, the operator may close safety valve 25 while bottom hole assembly 35 is within casing 31. That would, of course, result in shearing of wireline 37, but it could later be retrieved with a fishing tool. If wireline blowout preventer 40 is employed and is functioning, it may not be necessary to shear wireline 37 in the event of a pressure kick.

Figure 3:
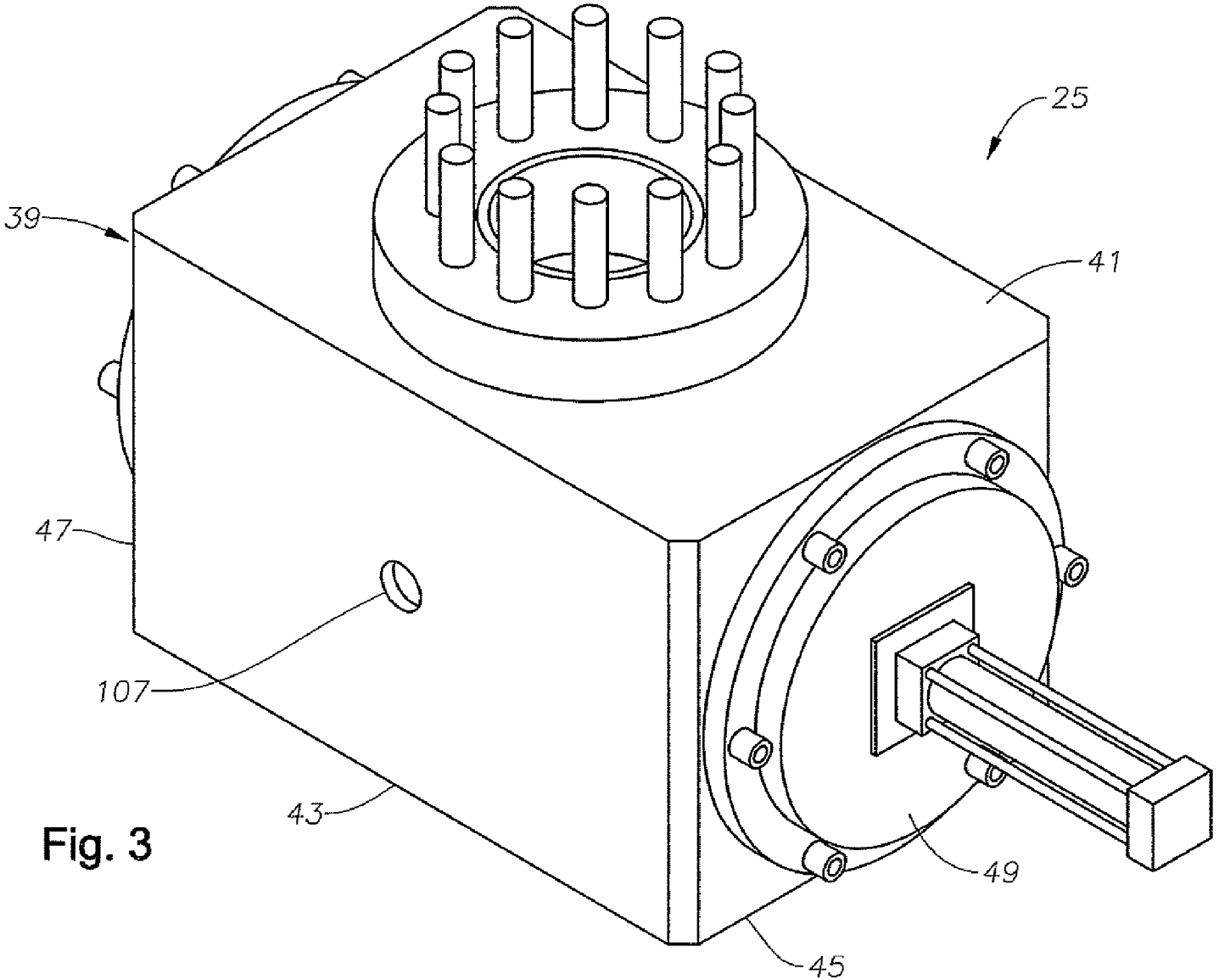
FIG. 3 is a perspective view of the safety valve of FIG. 1.

Referring to FIG. 3, safety valve 25 has a generally rectangular body 39 with an upper side 41, a lower side 43, a forward end 45 and a rearward end 47. The terms "forward" and "rearward" are used arbitrarily as the end on the left as shown in the drawing could just as well be termed a rearward end. End plates 49 are mounted on the forward and rearward ends 45, 47.

Figure 4:
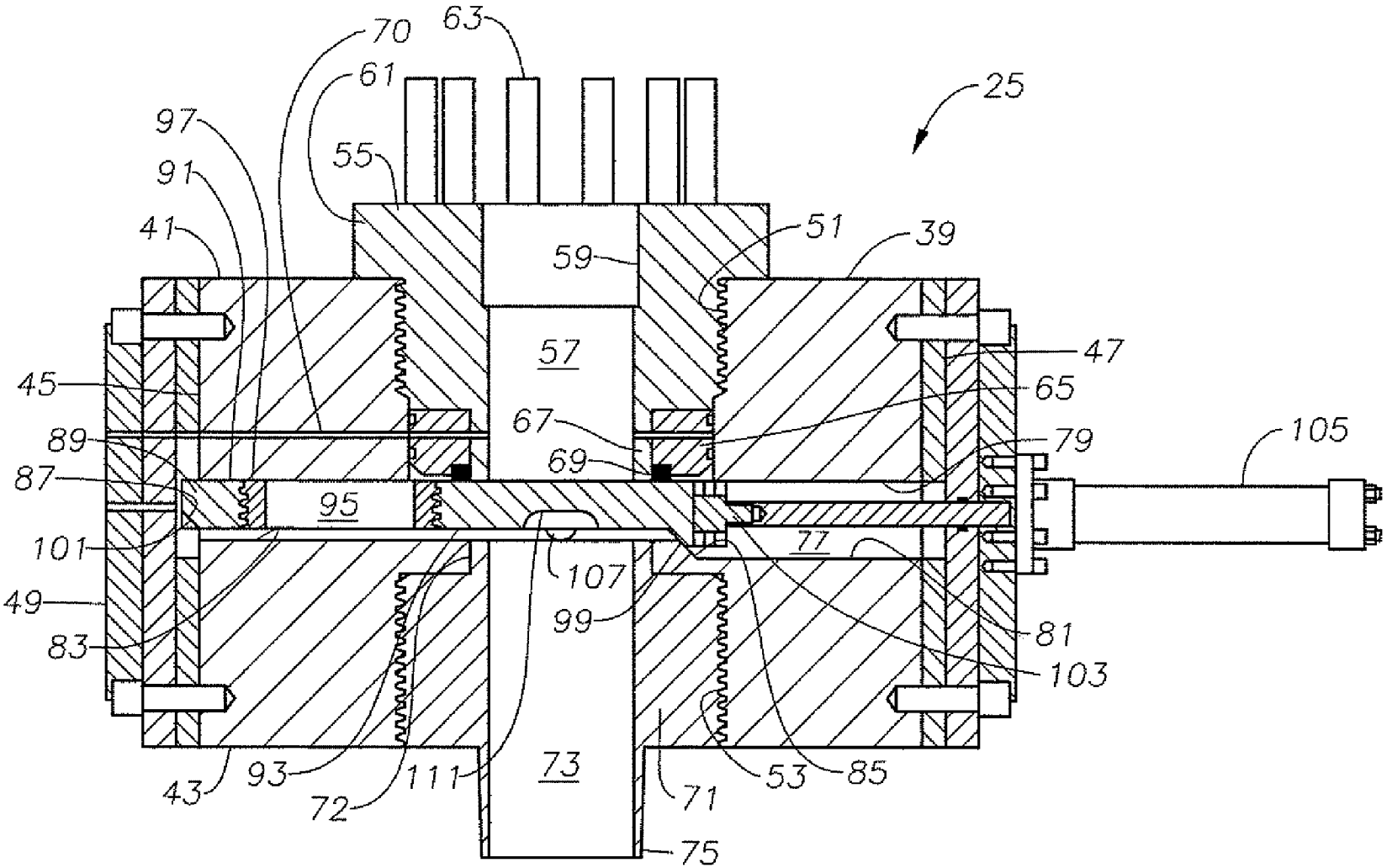
FIG. 4 is a vertical sectional view of the safety valve of FIG. 1.

Referring to FIG. 4, a threaded bore 51 is formed in upper side 41 of body 39. A lower threaded bore 53 is formed coaxially within lower side 43 of body 39. An upper adapter 55 has external threads that secure to upper threaded bore 51. A vertical flow passage 57 within upper adapter 55 has a set of internal threads 59 for securing to conduit 23 (FIG. 1). Upper adapter 55 in this example has an external flange 61 that overlies a portion of upper side 41.

Optionally, a plurality of studs 63 may extend upward from flange 61 to bolt to flanged equipment (not shown), such as an annular blowout preventer. For example, an operator might want to connect an annular blowout preventer to studs 63 when retrieving or running bottom hole assembly 35 with a string of drill pipe (not shown) lowered through casing 31. Because the weight of the string of casing 31 is supported by safety valve 25 as it located on rotary table 33, the operator could use elevators (not shown) suspended from top drive 11 to lift and lower the string of drill pipe within the string of casing 31.

A seat ring carrier 65 is located on a lower neck portion 67 of upper adapter 55. Seat ring carrier 65 has a seal or seat ring 69 on its lower side. Seat ring 69 is preferably of an elastomeric material, but it could be a metal seal material. Seat ring 69 protrudes a short distance below seat ring carrier 65 and encircles and is coaxial with flow passage 57. Seat ring 69 also extends a short distance below the lower end of neck portion 67. A passage 70 extends from the exterior through seat ring carrier 65. Passage 70 is part of a pressure equalizing feature of safety valve 25 that enables one to equalize pressure between its upper and lower sides before opening it.

A lower adapter 71 has an upward extending neck 72 and external threads that secure to lower threaded bore 53. Lower adapter 71 has a lower flow passage 73 extending through it that is coaxial with upper flow passage 57. In this example, lower adapter 71 has external threads 75 for securing to adapter 27 (FIG. 1), which in turn couples to casing 31. Upper and lower flow passages 57 and 73 could be formed directly in body 39. But upper and lower adapters 55 and 71 allow interchangeability with other adapters having different diameters of passages 57, 73. Once assembled, upper and lower adapters 55, 71 should be considered as part of body 39.

A chamber 77 extends horizontally within body 39. Chamber 77 is closed at its forward and rearward ends by end plates 49. Chamber 77 has an upper side 79 that may be flat and approximately in the same plane as the lower end of neck portion 67. Chamber 77 has a rearward lower side portion 81 which may be flat and parallel with upper side 79. Chamber 77 also has a forward lower side portion 83 that also may be flat and parallel with upper side 79. Forward lower side portion 83 is in a different plane than rearward lower side portion 81, thus is closer to upper side 79 in this example. Neck 72 of lower adapter 71 is flush with forward lower side portion 83.

The lower side 81, 83 of chamber 77 has at least one inclined guide surface. In this embodiment, an inclined ramp or rearward guide surface 85 joins rearward portion 81 with forward portion 83. Chamber 77 may also have a forward guide surface 87, which is also a ramp surface, but it extends upward from forward lower side portion 83. In this example, rearward guide surface 85 extends completely across the width of chamber 77, which is at least a width equal to an outer diameter of seat ring 69. Forward guide surface 87 could also extend the full width of chamber 77, but in this example, it is only a short segment centered within and extending less than the width of chamber 77. Rearward guide surface 85 is located a short distance rearward of neck 72 of lower adapter 71. Forward guide surface 87 is located at forward end 45 on the inside of the assembly of end plates 49. Guide surfaces 85, 87 are shown as having the same inclinations, but they could differ.

Figure 7:
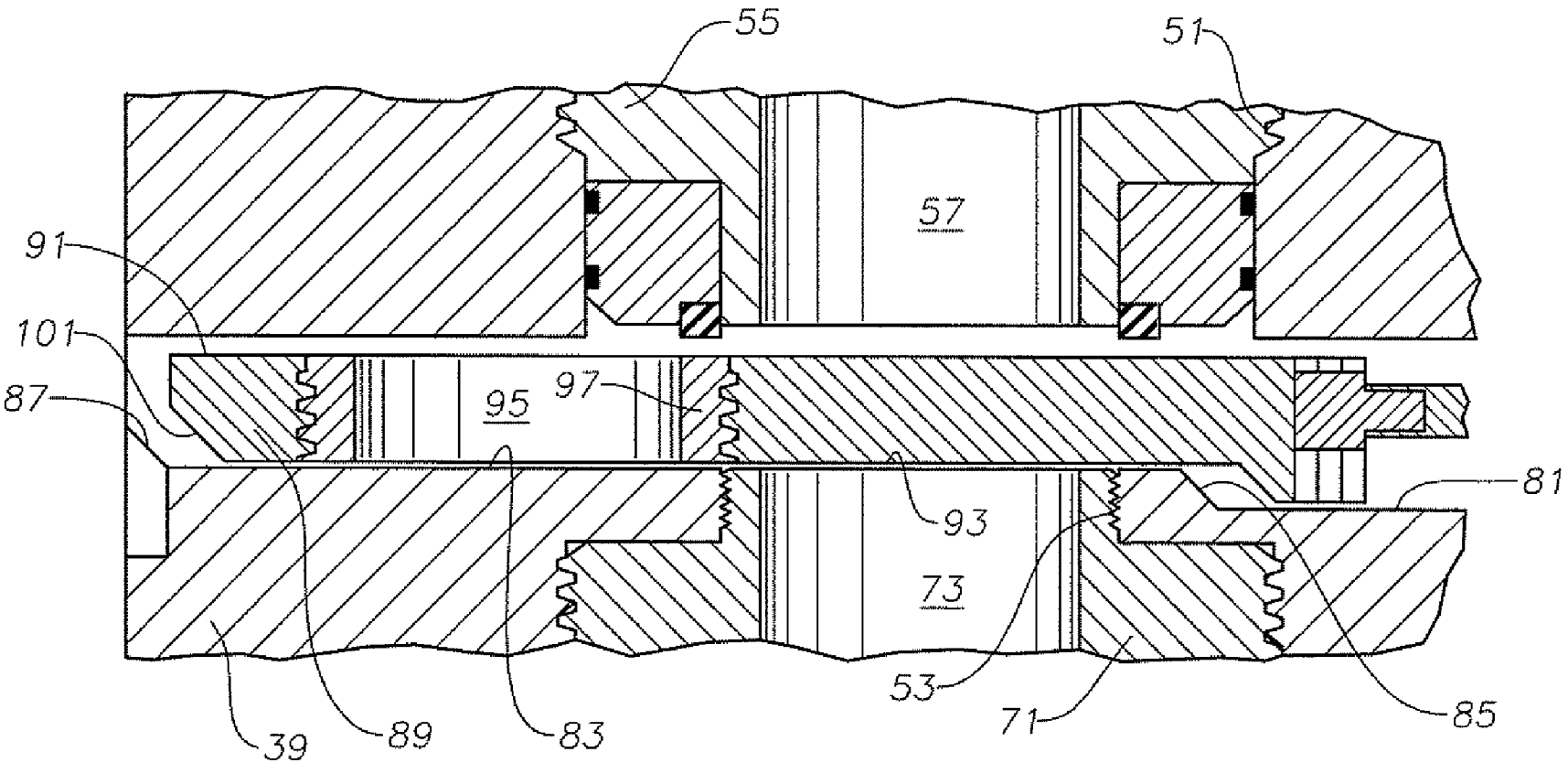
FIG. 7 is a partial sectional view of the safety valve of FIG. 1, illustrating the gate prior to reaching its closed position.

A gate 89 is carried reciprocally within chamber 77 for movement between rearward end 47 and forward end 45. Gate 89 is not split into two halves, rather it comprises a single slab. Gate 89 has a flat upper side 91 that is closely spaced to chamber upper side 79. When in the closed position, gate upper side 91 will be in abutment with seat ring 69. When other than in the closed position, a clearance will exist between gate upper side 91 and seat ring 69 as illustrated in FIG. 7.

Figure 5:
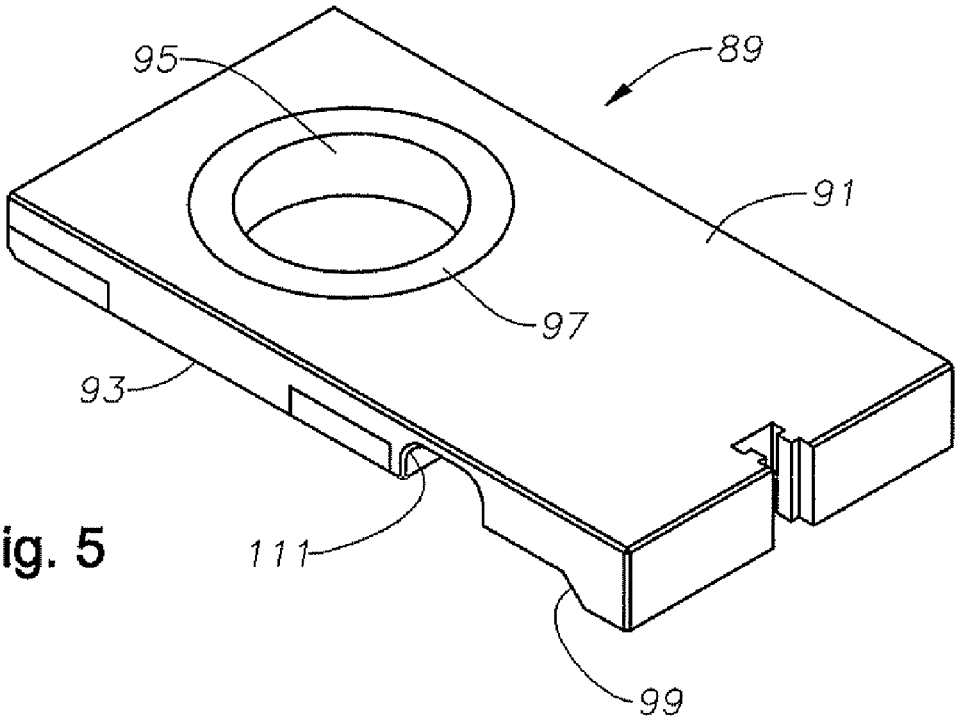
FIG. 5 is a top perspective view of the gate of the safety valve of FIG. 1.
Figure 6:
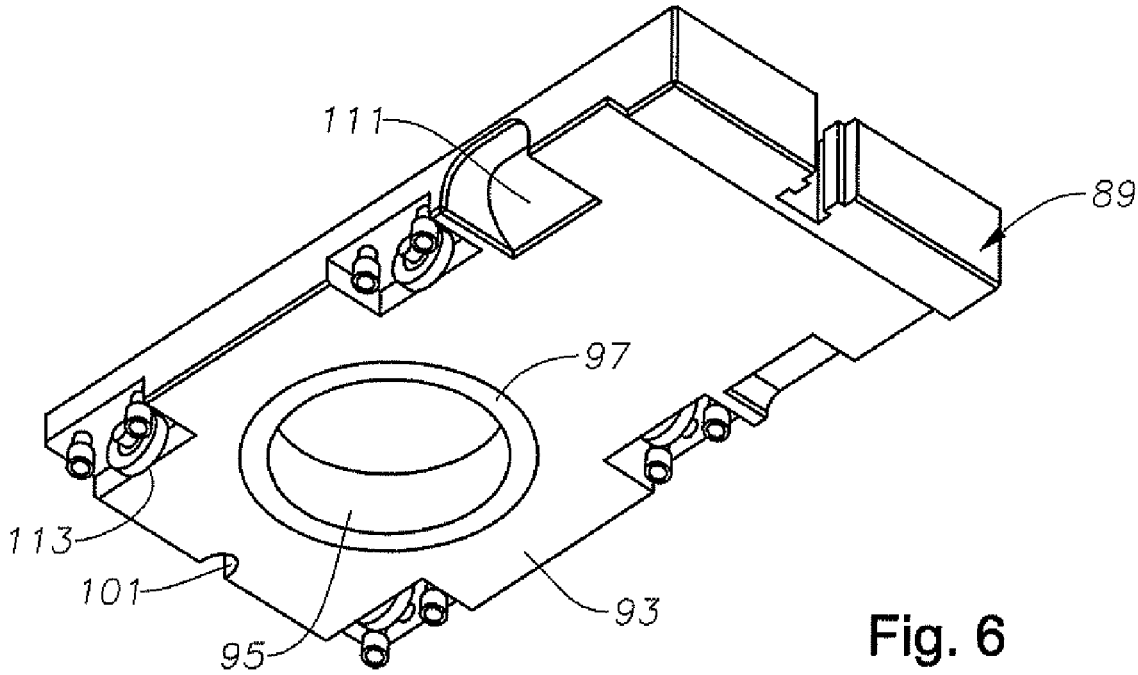
FIG. 6 is a bottom perspective view of the gate of the safety valve of FIG. 1.

Gate 89 has at least one ramp surface, and in this embodiment, has a rearward ramp surface 99 that is located near its rearward end, as shown in FIG. 5. As shown in FIG. 6, rearward ramp surface 99 extends the full width of gate 89 in this example. Gate 89 may also have a forward ramp surface 101 at its forward edge, as shown in FIG. 6. Forward ramp surface 101 is a central notch having much less width than gate 89 in this embodiment.

Gate 89 has at least one ramp surface, and in this embodiment, has a rearward ramp surface 99 that is located near its rearward end, as shown in FIG. 5. As shown in FIG. 6, rearward ramp surface 99 extends the full width of gate 89 in this example. Gate may also have a forward ramp surface 101 at its forward edge, as shown in FIG. 6. Forward ramp surface 101 is a central notch having much less width than gate 89 in this embodiment.

In this embodiment, a shaft 103 is flexibly connected to the rearward end of gate 89. Shaft 103 extends sealingly through a passage in end plates 49 on rearward end 47 and into a hydraulic cylinder 105. Cylinder 105 is supplied with hydraulic fluid pressure on one side of its piston to stroke shaft 103 and gate 89 in the forward direction. Cylinder 105 is supplied with fluid on the opposite side of its piston to stroke gate 89 in the rearward direction. Other mechanisms for stroking gate 89 could be employed, such as a manual wheel and threaded shaft. Moreover, a spring could be utilized for returning shaft 103 into cylinder 105.

Referring again to FIG. 3, a circulating passage 107 extends from the exterior into body 39 into chamber 77. In this example, circulating passage 107 is shown located on one of the vertical sides between forward end 45 and rearward end 47, but it also could be located elsewhere and on both sides to increase the amount of circulation fluid. Circulation port 107 communicates with lower flow passage 73 (FIG. 4). Rather than extending through threaded adapter 71, preferably circulating passage 107 extends into chamber 77 above lower adapter neck 72 near chamber lower side portion 83. Circulating passage 107 is connected to a circulating line 109 (FIG. 1) for pumping fluid into lower flow passage 73 (FIG. 4). So as to clear gate 89 while it is in the closed position shown in FIG. 4, a circulating port 111 extends within gate 89. As shown in FIG. 6, there are two circulating ports 111, one for each circulating passage 107 (FIG. 3). Each circulating port 111 comprises an open channel that registers with circulating passage 107 while gate 89 is closed. The channel of each circulating port 111 extends from a side edge of gate 89 inward a short distance and is open to gate lower side 93. The fluid thus flows from passage 107 (FIG. 3) into circulating port 111 and down into passage 73 (FIG. 4) when gate 89 is in the closed position.

FIG. 6 also illustrates an optional feature of rollers 113. Rollers 113 are mounted to the lower side 93 of gate 89. In this example, there are four rollers 113 symmetrically mounted around aperture 95. Rollers 113 are adapted to engage and roll on chamber lower side forward portion 83 (FIG. 4). Rather than rollers, other friction reducing elements could be employed, such as plastic skids.

In operation, during drilling, safety gate 25 would normally not be connected to casing 31. Rather, casing gripper 17 would grip and seal directly to casing 31. Top drive 11 would rotate casing 31 and drilling fluid would be pumped through hose 15 down casing 31.

When the operator wishes to change out bottom hole assembly 35 (FIG. 1), the operator would initially set casing 31 within slips in rotary table 33, detach casing gripper 17, connect safety valve 25 to casing 31 and close safety valve 25. When closing gate 89, as illustrated in FIG. 7, initially its upper side 91 will be spaced below seat ring 69 so as to avoid damaging contact as gate 89 moves transversely relative to seat ring 69. When inclined ramp surfaces 91 and 101 reach guide surfaces 85, 87, which occurs substantially simultaneously, they will cause gate 89 to move upward as hydraulic cylinder 105 (FIG. 4) pushes gate 89 forward. This upward movement deforms seat ring 69 and provides effective sealing contact with gate 89. At least one of the end connections of shaft 103 has sufficient flexibility to allow the upward and downward movement of gate 89. During the forward and rearward movement of gate 89, rollers 113 (FIG. 6) will roll along chamber lower side forward portion 83.

Conduit 23 is secured to safety valve 25 either before or after it is attached to casing 31. For a pump out retrieval, the operator connects casing gripper 17 and top drive 11 to conduit 23. Tool catcher 38 is preferably secured to casing gripper 17 before it is connected to conduit 23. The operator may lift safety valve 25, along with casing 31, by lifting top drive 11 while it is connected via casing gripper 17 to conduit 23. Once the slips in rotary table 33 have moved to the released position, the top drive 11 can be lowered to place safety valve 25 on rotary table 33 to support the weight of casing 31. If a pressure kick occurs while getting ready to retrieve bottom hole assembly 35 and before connecting casing gripper 17 to conduit 23, the operator can pump through line 109 and circulation port 107 while gate 89 (FIG. 4) is closed to reduce the bottom hole pressure.

For a pump out retrieval, the operator causes reverse circulation to occur, with the drilling mud around casing 31 flowing into the lower end of casing 31 and pushing bottom hole assembly 35 upward. Depending on the type of bottom hole assembly 35, it may be necessary to first pump down a release tool (not shown) to release a latch that secures bottom hole assembly 35 to casing 31. After bottom hole assembly 35 is pumped to the surface and engaged by tool catcher 38, the operator closes safety valve 25 and removes bottom hole assembly 35 from conduit 23. This may be done by disengaging casing gripper 17 from conduit 23 and lifting bottom hole assembly 35 from conduit 23 with top drive 11.

After replacing drill bit 36 or some other component, bottom hole assembly 35 is lowered into conduit 23. If tool catcher 38 is employed, top drive 11 and casing gripper 17 may be used to lower bottom hole assembly 35 into conduit 23. Casing gripper 17 then engages conduit 23, safety valve 25 is opened, and bottom hole assembly 35 is launched into casing 31. The operator pumps fluid through hose 15 and into casing 31 above bottom hole assembly 35 to pump it downward. Preferably safety valve 25 remains attached during the entire retrieval and re-run process. When drilling begins again, safety valve 25 and conduit 23 may be disconnected from casing 31 and casing gripper 17 reconnected to casing 31.

If wireline retrieval is employed as in FIG. 2, a similar procedure is employed. If a pressure kick occurs before bottom hole assembly 35 is below safety valve 25, the operator closes wireline blowout preventer 40 and pumps fluid through circulation line 109 and circulation passage 107. If a pressure kick occurs after wireline blowout preventer 40 is below safety valve 25, the operator may pump through circulation line 109 and passage 107 with safety valve 25 open and wireline blowout preventer 40 closed.

The safety valve provides additional protection during a casing-while-drilling operation when the casing gripper and top drive are disconnected from the casing. The circulation port allows circulation down the casing while the safety valve is closed. The ramp and inclined guide surfaces avoid damage to the seat ring as the gate is moved between open and closed positions. The safety valve allows an operator to trip a bottom hole assembly out and back in while the well is under a positive pressure at the surface.

While the invention has been shown in only one of its forms, it should be apparent to those skilled in the art that it is not so limited but is susceptible to various changes without departing from the scope of the invention.

The invention claimed is:

1. A safety valve, comprising:

a body having a flow passage extending therethrough that is intersected by a chamber;

a seat ring surrounding the flow passage at an upper side of the chamber, the seat ring having a face located in a plane perpendicular to a flow passage axis of the flow passage;

the chamber having a lower side with a rearward portion and a forward portion, the flow passage extending through the forward portion of the lower side of the chamber, the rearward portion being farther from an upper side of the chamber than the forward portion, the rearward portion being parallel to the forward portion and perpendicular to the flow passage axis;

an inclined guide surface located between and joining the rearward portion of the lower side of the chamber with the forward portion of the lower side of the chamber; and a single-slab gate having an aperture therethrough and a ramp surface a lower side of the gate, the gate being movable in forward and rearward directions in the chamber between an open position wherein the aperture aligns with the flow passage and a closed position wherein the ramp surface slides on the guide surface and pushes the gate into sealing engagement with the face of the seat ring to block the flow passage.

2. The safety valve according to claim 1, wherein while being moved toward the closed position, the gate is free of contact with the upper side of the chamber until the ramp surface engages the guide surface.

3. The safety valve according to claim 1, further comprising a plurality of friction reducing elements on the lower side of the gate that engage the forward portion of the lower side of the chamber.

4. The safety valve according to claim 1, further comprising:

a circulation passage extending through the body to the chamber;

a circulation port within the gate that is in fluid communication with a lower portion of the flow passage in the body and with the circulation passage while the gate is in the closed position, enabling fluid to be pumped into the lower portion of the flow passage while the gate is in the closed position: and wherein the gate is free of any positions that blocks communication of the circulation passage with the lower portion of the flow passage.

5. The safety valve according to claim 4, wherein the circulation port comprises an open channel in the lower side of the gate and extending inward from an edge of the gate.

6. A safety valve, comprising:

a body having forward and rearward ends and first and second sides facing in opposite directions;

a flow passage extending through the body from the first to the second side;

a chamber extending in forward and rearward directions and having first and second sides intersecting the flow passage, defining a first passage portion and a second passage portion, the second side of the chamber having a forward portion and a rearward portion, the forward portion being perpendicular to a flow passage axis of the flow passage. the first passage portion extending through the forward portion;

a seat ring in the chamber and surrounding a junction of the first passage portion with the first side of the chamber;

inclined forward and rearward guide surfaces on the second side of the chamber, the forward guide surface being on the forward portion of the second side of the chamber forward of the second passage portion, the rearward guide surface being on the rearward portion of the second side of the chamber rearward of the second passage portion, each of the guide surfaces inclining relative to the forward portion of the second side of the chamber; and a gate having first and second sides carried in the chamber, the gate having an aperture therethrough, the gate having forward and rearward ramp surfaces on the second side of the gate, the second side of the gate between the forward and rearward ramp surfaces being flat and substantially perpendicular to the flow passage axis, the gate being movable in forward and rearward directions in the chamber between an open position wherein the aperture aligns with the flow passage and a closed position wherein the forward and rearward ramp surfaces are engaged by the forward and rearward guide surfaces, respectively, thereby pushing the first side of the gate into sealing engagement with the seat ring and blocking the first passage portion.

7. The safety valve according to claim 6, wherein while being moved toward the closed position, the first side of the gate is free of contact with the seat ring until the ramp surfaces engage the guide surfaces.

8. The safety valve according to claim 6, further comprising a plurality of friction reducing elements on the second side of the gate that engage the second side of the chamber.

9. The safety valve according to claim 6, further comprising:

a circulation passage extending through the body to the chamber; and a circulation port within the gate that is in fluid communication with the second passage portion and with the circulation passage while the gate is in the closed position, enabling fluid to be pumped into the second passage portion while the gate is in the closed position.

10. The safety valve according to claim 9, wherein the circulation port comprises an open channel in the second side of the gate and extending inward from an edge of the gate.

11. The safety valve according to claim 6, wherein the portion of the body containing the first passage portion comprises:

a threaded bore extending from the first side of the body to the first side of the chamber; and an adapter having external threads that secure the adapter to the threaded bore, the first passage portion extending through the adapter and having a set of internal threads for threaded connection to a conduit.

12. The safety valve according to claim 6, wherein the portion of the body containing the second passage portion comprises:

a threaded bore extending from the second side of the body to the second side of the chamber; and an adapter having a first set of external threads that secure to the threaded bore, the second passage portion extending through the adapter, the adapter having a portion extending from the second side of the body and having a second set of external threads for threaded connection to a conduit.

13. The safety valve according to claim 6, wherein the portion of the gate containing the aperture comprises:

an internally threaded opening extending through the gate from the first side to the second side of the gate; and an adapter insert having external threads that secure to the threaded opening, the aperture extending through the adapter insert.

14. The valve according to claim 6, wherein the forward and rearward guide surfaces on the second side of the chamber incline at substantially the same angle relative to the forward portion of the second side of the chamber.

15. The valve according to claim 6, wherein while in the closed position, the forward and rearward guide surfaces will be in engagement with the forward and rearward ramp surfaces.

16. A safety valve, comprising:

a body having a flow passage extending therethrough that is intersected by a chamber, the chamber having upper and lower sides;

a seat ring mounted around the flow passage at the upper side of the chamber;

the lower side of the chamber having a rearward portion and a forward portion through which the flow passage extends, the rearward portion being farther from the upper side of the chamber than the forward portion;

a rearward inclined guide surface located between and joining the rearward portion of the lower side of the chamber with the forward portion of the lower side of the chamber, the rearward inclined guide surface being located rearward from the flow passage;

a forward inclined guide surface located at a forward end of the forward portion of the lower side of the chamber forward of the flow passage, the rearward inclined guide surface and the forward inclined guide surface being inclined relative to the forward and rearward portions of the lower side the chamber;

a single-slab gate having an aperture therethrough;

a rearward ramp surface on a lower side of the gate rearward of the aperture and a forward ramp surface on the lower side of the gate at a forward end of the gate; and wherein the gate is movable in the chamber between an open position wherein the aperture aligns with the flow passage and a closed position wherein the rearward and forward ramp surfaces are on the rearward and forward inclined guide surfaces, respectively, pushing an upper side of the gate into sealing engagement with the seat ring to block the flow passage.

* * * * *